US006908239B1

(12) United States Patent
Foster et al.

(10) Patent No.: US 6,908,239 B1
(45) Date of Patent: Jun. 21, 2005

(54) ARCUATE PRINT PATH TO AVOID CURL IN THERMAL PRINTING

(75) Inventors: David G. Foster, West Henrietta, NY (US); Cobb S. Goff, Webster, NY (US); Maurice L. Gray, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 4 days.

(21) Appl. No.: 10/370,787

(22) Filed: Feb. 20, 2003

(51) Int. Cl.[7] ..... B41J 2/325

(52) U.S. Cl. ..... 400/120.02; 400/120.01; 347/172; 347/173; 347/213

(58) Field of Search ..... 400/120.01, 120.02, 400/120.03, 120.04; 347/171, 172, 173, 175, 213

(56) References Cited

U.S. PATENT DOCUMENTS 4,008,998 A * 2/1977 Serex et al. ..... 8/471
4,157,412 A * 6/1979 Deneau ..... 428/147
4,621,271 A 11/1986 Brownstein
5,179,390 A * 1/1993 Yokoyama et al. ..... 347/215
5,247,314 A * 9/1993 Stephenson ..... 347/173
5,546,115 A * 8/1996 Nardone et al. ..... 347/214
5,940,112 A * 8/1999 Siwinski ..... 347/218
5,951,181 A * 9/1999 Hierro et al. ..... 400/645
5,973,711 A * 10/1999 Schartner et al. ..... 347/173
6,262,755 B1 * 7/2001 Skubic et al. ..... 347/173
6,273,984 B1 * 8/2001 Bourdelais et al. .... 156/244.22
6,318,254 B1 * 11/2001 Saitoh et al. ..... 101/116
6,704,037 B1 * 3/2004 Taguchi ..... 347/213

* cited by examiner

*Primary Examiner*—Stephen R. Funk
*Assistant Examiner*—Dave A. Ghatt
(74) *Attorney, Agent, or Firm*—Paul A. Leipold

(57) ABSTRACT

The invention relates to a method of avoiding core set curl in thermal prints comprising providing thermal print material wound image receiving side toward the core, passing said print material from said core around a turning roll in a direction opposite to the core wind, passing said print material under tension in an arcuate path with image side out beneath at least three thermal print heads to form an image.

17 Claims, 1 Drawing Sheet

ARCUATE PRINT PATH TO AVOID CURL IN THERMAL PRINTING

FIELD OF THE INVENTION

This invention relates to a dye-donor element for thermal dye transfer, and more particularly to a method of winding donors and designing the donor path used for such elements in a multi-head thermal printer system resulting in less printing artifacts, less cooling requirements to sustain printing for longer times, and the ability to better operate in higher temperature environments.

BACKGROUND OF THE INVENTION

In recent years, thermal transfer systems have been developed to obtain printed output from images generated from various electronic capturing devices and methods. An electronic image is first subjected to color separation by color filters. The respective color separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The donor element and dye receiving element are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. The dye is transferred from these selectively heated regions of the dye donor sheet to the receiver sheet to form a pattern with a shape and intensity that corresponds to the pattern and intensity of the heat applied to the dye donor element. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling a Thermal Printer Apparatus," issued Nov. 4, 1986, the disclosure of which is hereby incorporated by reference.

The thermal print-head contains a very hot print element that is in intimate contact with a dye donor ribbon. The current donor ribbon is designed to contain a heat resistant or slipping layer on one side to facilitate movement of the donor element across the print head. The opposite side is comprised of cyan, magenta and yellow dye and laminate that are patch coated on the opposite side of the support that is typically polyethylene terephthalate (PET).

The purpose of the slipping layer is to facilitate printing by providing a surface that can survive contact with the hot print head and is also lubricious enough to allow movement across the head.

The dye side of the patch coated donor ribbon contains alternating patches of cyan dye, magenta dye, yellow dye, and laminate that are printed in succession. Because few materials stick to PET, it is necessary to have an adhesive layer in between the slip and PET, as well as in between the PET and dye layers.

As the print is made, the receiver which is a dye receiving layer coated on paper support, moves through the printer, it receives the yellow dye, backs up, receives the magenta dye, backs up, receives the cyan dye, backs up, and lastly receives the protective laminate layer. The receiver is traditionally fed through the printer in sheet format. Print time for an 8×10 inch print is approximately 90 seconds with this method.

As the system evolves into higher volume applications, a multi-head printing system is necessary to allow faster printing times. However, when faster printing times under multiple printing heads is carried out there are problems created by the need to successively pass from a wound roll of receiver material through the multiple heads. These problems include tracking of the receiver material through the printer such that the printing heads remain in registration. Other problems are that the receiver material is more subject to curl as it passes through 3 or 4 printing heads where the material is heated as well as the effect of having been wound on a roll. Receiver material that has been wound on a roll tends to have a property called core set which causes the receiver, after removal from the roll, to remain in the curvature of the roll. Nevertheless, use of roll fed receiver material is considered highly desirable for utilization in a higher speed machine.

PROBLEM TO BE SOLVED BY THE INVENTION

There is a need for an improved apparatus and method for printing thermal receiver material at higher speeds without defects such as curl and print registration problems.

SUMMARY OF THE INVENTION

It is an object of the invention to overcome disadvantages of prior thermal printing techniques.

It is another object to provide a method of avoiding core set of receiver material in thermal printing.

These and other objects of the invention are accomplished by a method of avoiding core set curl in thermal prints comprising providing thermal print material wound image receiving side toward the core, passing said print material from said core around a turning roll in a direction opposite to the core wind, passing said print material under tension in an arcuate path with image side out beneath at least three thermal print heads to form an image.

ADVANTAGEOUS EFFECT OF THE INVENTION

The invention provides a method for printing thermal receiver material at higher speeds without defects such as curl and print registration problems.

DETAILED DESCRIPTION OF THE INVENTION

Figure 1:
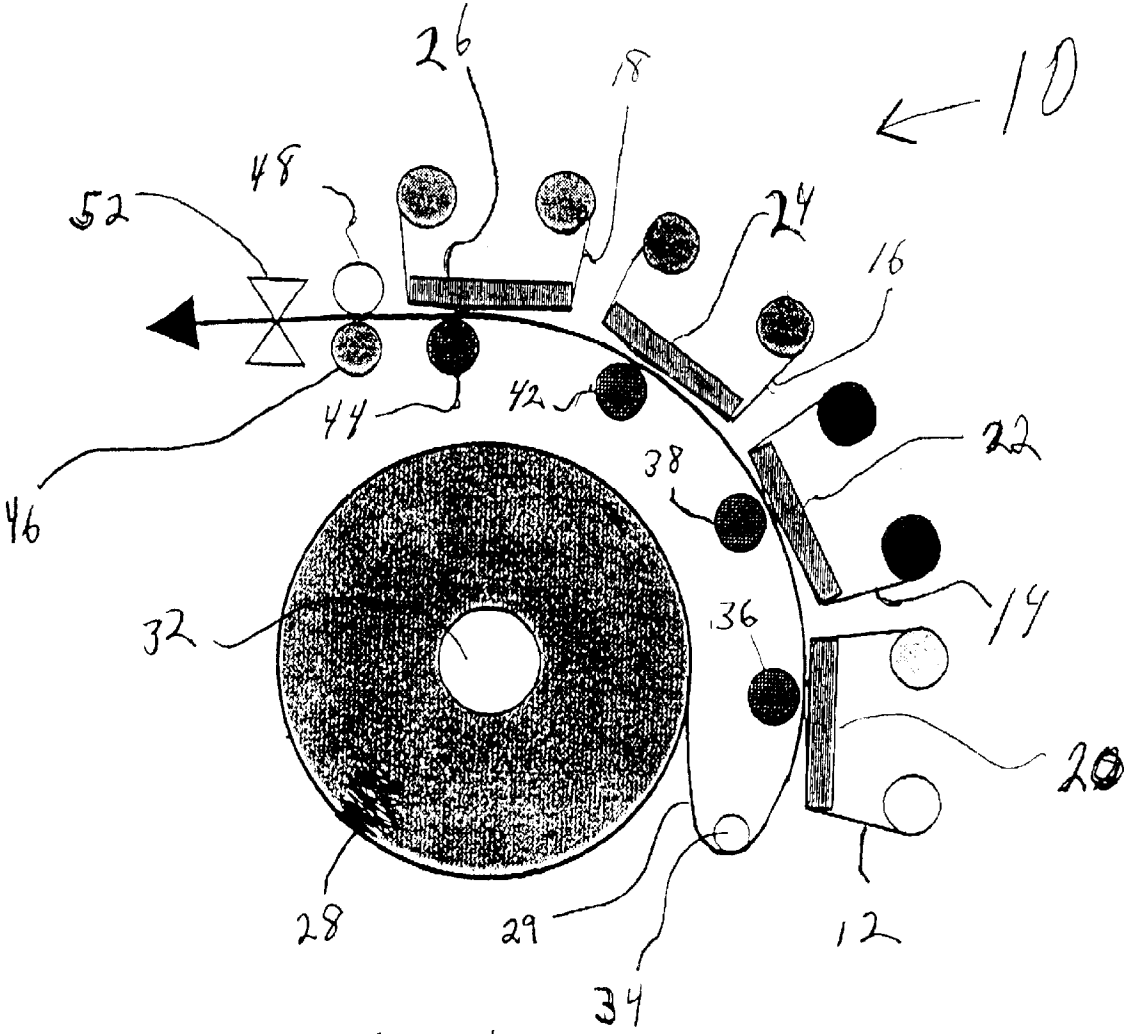
FIG. 1 is a schematic illustration of the method of the invention.

The invention provides numerous advantages over the prior practice. The invention allows the use of rolls of receiver material in a high speed thermal printer. The invention minimizes core set curl as well as thermal effects of multiple printing heads in a thermal printer. The prints formed utilizing the method of the invention are of high quality and have low curl. The prints further have exceptional registration of the cyan and magenta colors to form a high quality print. The final images after being cut into sheets further are generally flat during storage. These and other advantages will be apparent from the detailed description below.

FIG. 1 depicts a multihead printer configuration. In the figure, the printer (10), has yellow (12), magenta (14), cyan

(16) and laminate (18) donor ribbons. Each donor ribbon has an associated print head, a print head for the yellow donor (20), a print head for the magenta donor (22), a print head for the cyan donor (24) and a print head for the laminate (26). The roll of receiver (28) is unwound and moves on its associated path as the receiver (29) moves through the printer (10). The roll fed receiver (28) as it is removed from core (32) passes over curl reversing roller (34). The receiver (28) then passes over donor tracking roller (36) at the yellow image print head (20), then between print head (22) and tracking roller (38). The receiver (29) with yellow and magenta colorants then passes between cyan print head and tracking roller (42) prior to passing between thermal laminate print head (26) and tracking roller (44). The receiver (29)is driven by drive roll (46) that is opposite pinch roll (48) as it unwinds from roll(28). The receiver (29) with an image then passes through cutter (52) where it is cut into prints of useful size.

In use, yellow, magenta and cyan dyes are thermally transferred from a dye-donor element to form an image on the dye-receiving sheet. The thermal laminate print head (26) is then used to transfer the clear protection layer, from a separate donor element (18), onto the imaged receiving sheet by uniform application of heat. The clear protection layer adheres to the print and is released from the donor support in the area where heat is applied.

In the invention the path of the receiver element is around a curl reversing roller (34). This roller serves to aid in reversal of the core set curl of the receiver. The arcuate path beneath the 4 print heads also aid in curl reversal. The receiver preferably passes at an angle of between 90 and 180 degrees as it passes around the curl reversing roll. By this it is meant that the path of the receiver entering the roll and the path of the receiver when leaving the roll if continued would form the 90 to 180 degree angle of turn.

The tension of the print material is controlled as it passes through the thermal printer such that the material is not deformed but is drawn at such a tension that it remains flat and in contact with the print heads. It has been found that a tension of greater than 4.0 kilograms is suitable. A preferred tension is between 5 and 10 kilograms as this provides good print quality and reliable curl prevention of the receiver.

The method of the invention allows a print material to be provided to the thermal printer that is quite wide. It has been found that the printing method of the invention allows print material of greater than 20 cm to be formed with good image quality. A suitable width is between 20 and 100 cms wide as this allows high productivity with good image quality.

In order for good image transfer at high efficiency has been found that temperatures greater than 30° C. should be present at the time the receiver is fed to the print station. A preferred temperature of the receiver when it enters the first print station is between 30° and 44° C. as this allows efficient transfer of material to the donor receiver without overheating of the material by the print head.

The method of the invention may be carried out at a productivity that is higher than previously possible with thermal printers forming high quality prints. The method allows a rate of between 0.5 and 2 meters per minute with high quality print production. A preferred rate is between 1 and 1.5 meters per minute for highest quality prints. The path through the machine generally is greater than 35 cm in length from the time the print material leaves the core roll until it leaves the thermal printer and enters the cutters.

The base material for the receiver may be any material that provides sufficient strength and temperature resistance to withstand the conditions of thermal processing at high speeds. The base should not stretch or deform under the tensions utilized in the method. Further, the receiver needs to withstand the heat of the transfer head without deformation. Generally, the material may have a paper core with polymer layers on each side. A preferred form has a biaxially oriented polymer sheet on each side of a paper core. The preferred biaxially oriented polymer sheet has a voided core for higher reflectivity. The biaxially oriented polymer sheet, preferably polypropylene, also provides a smooth surface for the receiver layer for better image formation.

The image receiving layer of the receiver comprises any material that will accept the thermally transfer dye at the print heads. Typical suitable materials are polyurethane, poly(vinyl chloride), poly(styrene-co-acrylonitrile), polycaprolactone or mixtures thereof. Preferred receiver materials comprise polycarbonate and polyester polymers as they provide a manufacturable and stable dye receiving layer that provides high quality images. The dye receiving layer is preferably 3 $\mu$m in thickness. The overall thickness of the receiver is preferably 220 $\mu$m for good transport and print quality.

The method of the invention may be utilized to form images that have a variety of uses. With selection of proper receiver, the method can be utilized to form posters, post cards, labels, and images for personal and professional use that are printed from digital image files obtained from digital cameras or other sources.

In a preferred method it has been found there is a need for yellow dye donor elements that are capable of performance at high rates of productivity with efficient transfer and good image formation. In order to accomplish this it has been found that close control of the composition of the dye donor layer and the base material will allow efficient transfer at higher speeds. It has been found that by controlling the ratio of yellow dye and binder ratio to between 0.6 and 0.7 the transfer results arc improved. Further, it has been found that the thickness of the base below the dye transfer layer also is important in effective transfer at higher speeds. It has been found that a polyethylcneterephthalate polymer base is preferred as it is stable during heating and strong. A preferred thickness has been found to be between 4 and 4.75 micrometers for efficient heat transfer and sufficient strength to prevent folds and creases in the donor sheet during feeding and printing for image transfer.

It has been found that for preferred performance the dye weight in the dye donor layer of the donor sheet preferably has a coverage of between 0.05 to about 1 g/m$^3$. This is preferred as it provides sufficient dye for good density in the image formed. The glass transition temperature of the donor layer is suitably between 25 and 60° C.

In order to obtain good images in the image formation it has also been found that when utilizing the method of the invention, that the print head be preferably heated using a power range of less than 0.066 watts per dot. A most preferred power range has been found to use a power range of 0.057 and 0.063 watts per dot for best density of yellow, magenta and cyan dye transfer at higher speeds. The yellow, magenta and cyan dye donors in the method of the invention has been found to be satisfactorily operated at speeds of greater than 1.1 meters per minute.

Any dye can be used in the dye layer of the dye-donor elements provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

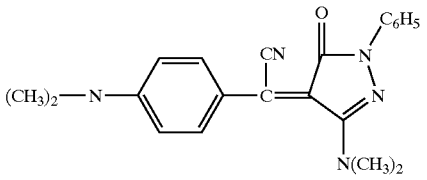

(magenta)

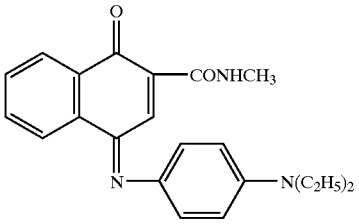

(cyan)

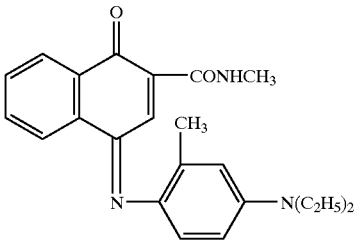

(cyan)

The dyes disclosed in U.S. Pat. No. 4,541,830, may also be utilized. The above dyes may be employed singly or in combination to obtain a monochrome. The dyes may be used at a coverage of from about 0.05 to about 1 g/m$^2$ and are preferably hydrophobic.

Any suitable yellow dye may be utilized in the invention. In a preferred embodiment the yellow dyes are:

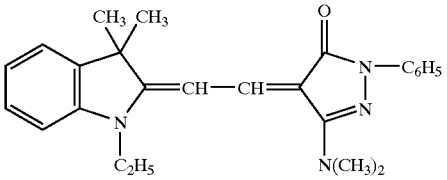

(yellow)

-continued

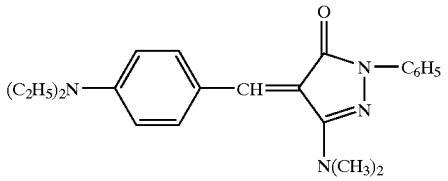

(yellow)

because these dyes have been shown to give the best color reproduction, raw stock keeping and transfer efficiency.

The yellow, cyan and magenta dyes in their respective donor layers are in a binder material. The binder material may be any suitable material that will transfer when heat is applied to the donor element. The binder material also should be coatable, compatible with the receiver, compatible with the dyes for keeping without fade, and stable in the thermal printing environment. Suitable materials are polyvinyl acetal, cellulose acetate hydrogen phthalate, cellulose acetate propionate, cellulose acetate butyrate, and cellulose triacetate. A preferred material for utilization of the yellow layer of the invention is cellulose acetate propionate as this material provides good keeping properties and exceptional transfer properties.

The dye layers and protection layer of the dye-donor element may be coated on the support or printed thereon by a printing technique such as a gravure process.

A slipping layer may be used on the back side of the dye-donor element to prevent the printing head from sticking to the dye-donor element. This slipping layer does not contain transferable dye. Such a slipping layer would comprise either a solid or liquid lubricating material or mixtures thereof, with or without a polymeric binder or a surface-active agent. Suitable lubricating materials include oils or semi-crystalline organic solids that melt below 100° C. such as poly(vinyl stearate), beeswax, perfluorinated alkyl ester polyethers, poly-caprolactone, silicone oil, poly (tetrafluoroethylene), carbowax, poly(ethylene glycols), or any of those materials disclosed in U.S. Pat. Nos. 4,717,711; 4,717,712; 4,737,485; and 4,738,950. Preferred lubricating materials arc polymethylsiloxanes. Preferred polymeric binders for the slipping layer include poly(vinyl alcohol-co-butyral), poly(vinyl alcohol-co-acetal), polystyrene, poly (vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element utilized in the invention provided it is dimensionally stable and can withstand the heat of the thermal printing heads. Such materials include polyesters such as poly (ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The preferred support for this application is poly(ethylene terephthalate). The support generally has a thickness of from about 2 to about 30 $\mu$m. The yellow donor element of the invention preferably has a support thickness of between 3 and 6 micrometers. A most preferred thickness of the base of the yellow donor is between 4 and 4.75 micrometers for efficient transfer of the yellow dye layer while maintaining the dimensional stability of the base.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The yellow, cyan, magenta dye donor elements of the invention are used to form a dye transfer image by combination of the yellow, cyan and magenta dyes that are transferred from the donor ribbons. Such a process comprises imagewise heating a dye-donor elements as described above and transferring a dye image to a dye receiving element to form the dye transfer image. After all the dye images are transferred, the protection layer is then transferred on top of the dye image.

The dye donor clement of the invention maybe used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) utilizing the yellow dye layer of the invention are included within the scope of the invention.

In a preferred embodiment of the invention, the dye-donor element comprises a poly(ethylene terephthalate) support coated with a continuous dye layer and the protection layer noted above. As a result, there is a yellow ribbon, a cyan ribbon, a magenta ribbon and an optional laminate ribbon as illustrated in FIG. 1. When the process is only performed for a single color, then a monochrome dye transfer image is obtained.

Thermal printing heads which can be used to transfer dye from the dye-donor elements of the invention are available commercially. There can be employed, for example, a Fujitsu Thermal Head FTP-040 MCSOO1, a TDK Thermal Head LV5416 or a Rohm Thermal Head KE 2008-F3.

A thermal dye transfer assemblage utilizing the invention comprises (a) a yellow dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

A transferable protection layer may be applied that comprises microspheres dispersed in a polymeric binder which also contains inorganic particles. Many such polymeric binders have been previously disclosed for use in protection layers. Examples of such binders include those materials disclosed in U.S. Pat. No. 5,332,713, the disclosure of which is hereby incorporated by reference. In a preferred embodiment of the invention, poly(vinyl acetal) is employed.

The inorganic particles useful in the protection layer of the donor element may be, for example, silica, titania, alumina, antimony oxide, clays, calcium carbonate, talc, etc. as disclosed in U.S. Pat. No. 5,387,573. In a preferred embodiment of the invention, the inorganic particles are silica. The inorganic particles improve the separation of the laminated part of the protection layer from the unlaminated part upon printing.

The protection layer contains from about 5 % to about 60 % by weight inorganic particles, from about 25 % to about 60 % by weight polymeric binder and from about 5 % to about 60 % by weight of the unexpanded synthetic thermoplastic polymeric microspheres.

The following example illustrates the practice of this invention. They are not intended to be exhaustive of all possible variations of the invention. Parts and percentages are by weight unless otherwise indicated.

The following examples illustrate the practice of this invention. They are not intended to be exhaustive of all possible variations of the invention. Parts and percentages are by weight unless otherwise indicated.

EXAMPLES

A thermal receiver of the structure in Table 1 below was kept for 6 months at room temperature. A sample was taken next to the core and measured for core set curl. This same sample was printed and after printing had significantly less curl. Curl was measured by placing an unrestrained 21.6 cm×27.9 cm paper on a flat surface and measuring how far one end curls up from the table. The element had an overall thickness of about 220 $\mu$m and a thermal dye receiver layer thickness of about 3 $\mu$m.

TABLE 1

| |
|---|
| 4–8 $\mu$m divinyl benzene beads and solvent coated cross-linked polyol dye receiving layer |
| Subbing layer |
| [ethylene-propylene coppolymer / voided polypropylene / polythylene]$_{\text{3 layer film}}$ |
| Pigmented polyethylene |
| Cellulose Paper |
| Polyethylene |
| Polyproplene film |

TABLE 2

| | Before Printing | After Printing in Multihead Printer |
|---|---|---|
| Amount of Core Set Curl | 6.6 cm | .05 cm |

As is clear from Table 2, the sheet inspite of exhibiting significant core set prior to imaging exhibits a flat image sheet after the method of the imaging is utilized to form an image. This demonstrates the effectiveness of the method of the invention.

The invention has been described in detail with particular reference to certain preferred embodiments thereof, but it will be understood that variations and modifications can be effected within the spirit and scope of the invention.

What is claimed is:

1. A method of avoiding core set curl in thermal prints comprising providing thermal print material wound image receiving side toward the core, passing said print material from said core around a turning roll in a direction opposite to the core wind, passing said print material under tension in an arcuate path with image side out beneath four thermal print heads to form an image, wherein said print material is carried over a path of greater than 35 centimeters in the path from the roll until it leaves the print heads.

2. The method of claim 1 wherein said print material passes around said turning roll at an angle between 90 and 180 degrees.

3. The method of claim 1 wherein said print material is under a tension of greater than 2.0 kilograms.

4. The method of claim 3 wherein said tension is between 2.0 and 4.0 kilograms.

5. The method of claim 4 wherein said method is carried out at a temperature of greater than 30° C.

6. The method of claim 5 wherein said method is carried out at between 30° C. and 44° C.

7. The method of claim 1 wherein said print material is greater than 20 centimeters wide.

8. The method of claim 7 wherein said print material is between 20 and 100 centimeters wide.

9. The method of claim 1 wherein said method is carried out at a rate of between 1 and 1.5 meters per minute.

10. The method of claim 1 wherein said method is carried out at a rate of between 0.5 and 2 meters per minute.

11. The method of claim 1 wherein said print material comprises an image receiving layer and a base material.

12. The method of claim 11 wherein said base material comprises a laminated structure comprising a paper core and at least one biaxially oriented sheet.

13. The method of claim 12 wherein said base material has a biaxially oriented sheet on each side of said paper core.

14. The method of claim 11 wherein said image receiving layer comprises polyester.

15. The method of claim 11 wherein said image receiving layer comprises polycarbonate.

16. The method of claim 1 wherein said print material comprises material suitable for use in postcards.

17. The method of claim 1 wherein said print material comprises material suitable for use as labels.

* * * * *